United States Patent [19]

Menton

[11] Patent Number: 4,466,403

[45] Date of Patent: Aug. 21, 1984

[54] SWING THROW CRANK STRUCTURE

[76] Inventor: Jack K. Menton, 1611 Peacock Blvd., Oceanside, Calif. 92056

[21] Appl. No.: 451,286

[22] Filed: Dec. 20, 1982

[51] Int. Cl.[3] ..... F02B 75/32

[52] U.S. Cl. ..... 123/197 AC; 123/197 R; 123/54 A; 74/602

[58] Field of Search ..... 123/197 R, 197 AB, 197 AC, 123/54 R, 54 A, 54 B; 74/602

[56] References Cited

U.S. PATENT DOCUMENTS

| | | | |
|---|---|---|---|
| 1,349,660 | 8/1920 | Buhl | 123/197 AC |
| 3,985,114 | 10/1976 | Vallejos | 123/197 R |
| 4,301,776 | 11/1981 | Fleming | 123/197 R |

*Primary Examiner*—Craig R. Feinberg
*Assistant Examiner*—David A. Okonsky
*Attorney, Agent, or Firm*—William C. Babcock

[57] ABSTRACT

A swing throw crank structure for transforming the reciprocating movement of a piston to rotary power that is delivered to a drive shaft at a substantially higher torque than that attainable when a conventional crank mechanism is employed for this purpose.

4 Claims, 6 Drawing Figures

SWING THROW CRANK STRUCTURE

DESCRIPTION OF THE PRIOR ART

In the operation of internal combustion engines, it is necessary to cause ignition of the air fuel mixture in each of the cylinders at the moment of highest compression if maximum power and efficiency is to be obtained. Thus, the ignition system of the engine must be timed so that the charge of fuel in each cylinder is fired when the piston is at, or substantially at, the limit of its upward movement in the cylinder. In present day high speed engines, the firing of the fuel charge in a particular cylinder occurs slightly before the crank shaft reaches top dead center with respect to the cylinder, with the momentum of the crank shaft and of the fly wheel associated therewith being relied upon to position the piston for initiating the power stroke.

From the above described relation of the parts it will be apparent that at the moment the charge of fuel is ignited, the initial force developed by the explosion of the gases in the cylinder is wasted or lost by reason of the fact that the power is expended along the connecting rod in a direct line with the crank shaft center line. This loss of power also occurs when the crank is only a few degrees past dead center, with maximum efficiency not being obtained because the explosive forces are expended in driving the crank webs in the main downwardly rather than laterally.

It is therefore desirable to have the explosion occur when the crank shaft throw is well past top dead center so that the entire force of the explosion may be utilized in the application of a turning force upon the crank shaft. In present day engine constructions of the type in which the connecting rod is journaled directly to the crank shaft throw, if the explosion is timed to occur when the crank shaft throw is past dead center, the explosion will occur when the gases are not at peak compression and hence will not develop the maximum possible pressure.

A major object of the present invention is to provide a swing throw crank structure that minimizes the above described operational disadvantage of an internal combustion engine, by having the explosive charge ignited in the cylinder when the piston is at substantially dead center, but with the power stroke developing when the swing throw is approximately 65° past this position, and as a result a substantial increase in foot pounds of torque over that attained by conventional cranks being delivered to the crank shaft.

A further object of the invention is to provide a swing throw crank assembly that increases the length of throw of the power stroke, and shortens the length of throw on the compression stroke in the operation of an internal combustion engine. Yet another object of the invention is to furnish a swing throw crank assembly that has a simple mechanical structure, and is adopted for use on either two or four cycle engines, as well as diesel engines.

These and other objects and advantages of the present invention will become apparent from the following description of the preferred form thereof.

SUMMARY OF THE INVENTION

The swing throw crank structure of the present invention is used in conjunction with first and second parallel, laterally spaced, rotor plates that are coaxially aligned and secured together in a fixed relationship. The first rotor plate has an arcuate slot in the side surface most adjacent the second rotor plate, and the second rotor plate has an arcuate opening therein that is transversely aligned with the slot. The first rotor plate is secured to the drive shaft.

A force transmitting assembly is situated between the first and second rotor plates and includes an elongate arcuate body that has first and second end portions, a first arcuate force transmitting member projecting rearwardly from the body that slidably engages the slot, and a second arcuate force transmitting member that projects forwardly from the body and slidably engages the opening. First and second transversely spaced cam rollers are rotatably supported from first and second end portions of the body.

A stub shaft extends forwardly from the second force transmitting member and is rotatably engaged by the journal of a connecting rod that extends upwardly to a piston that reciprocates in a cylinder. The cylinder forms part of a conventional internal combustion engine and the piston moves in response to the ignition of charges of fuel that are periodically exploded when the piston is at substantially top dead center.

First and second generally elliptical, transversely spaced cam surfaces are defined that at all times engaged by the first and second cam rollers, and are so related to the forced transmitting assembly that the movement of the piston from top dead center on the power stroke starts only after a major portion of the second forced transmitting member and the portion of the forced receiving edge of the opening in contact therewith have moved to a position substantially to one side of the axis of rotation of the first and second rotor plates, and continue to be so disposed until substantially bottom dead center on the power stroke is reached. As a result of the relationship above described the torque on the drive shaft over that attained when a conventional crank is employed to rotate the drive shaft is substantially increased.

DESCRIPTION OF THE PREFERRED FORM OF THE INVENTION

Figure 1:
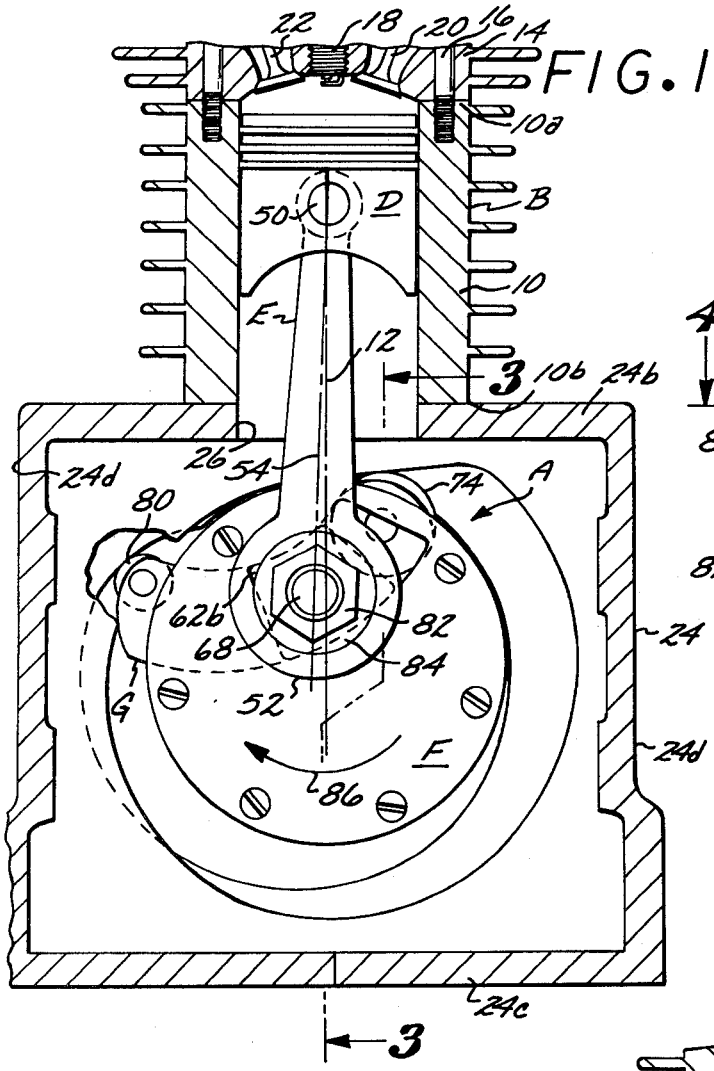
FIG. 1 is combined vertical cross sectional and front elevational view of an internal combustion engine illustrating the piston coming up on the compression stroke towards top dead center, with the swing throw crank structure being moved transversely across the first and second co-axially aligned rotor plates.
Figure 2:
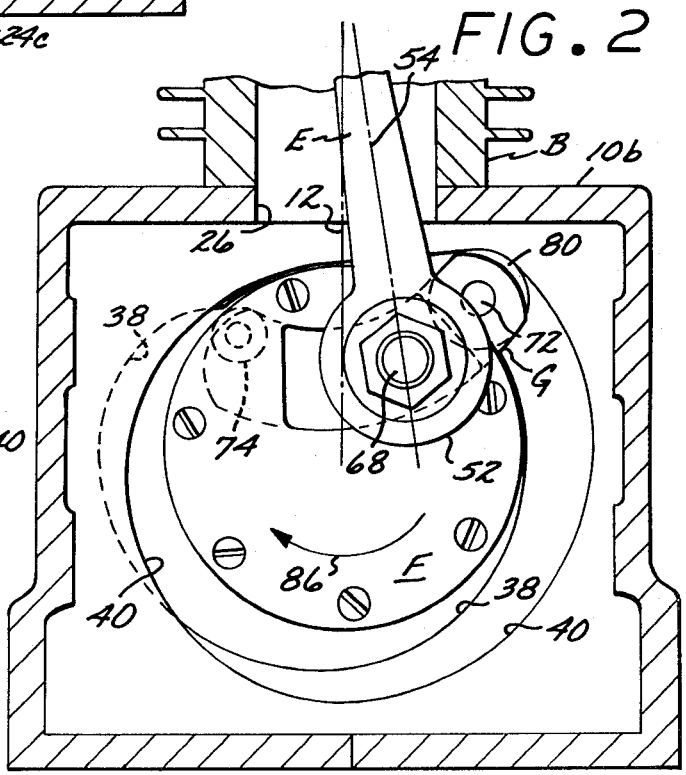
FIG. 2 is the same view as in FIG. 1 but with the piston having moved to top dead center where the fuel mixture is ignited at maximum compression, and the swing throw structure having moved the lower connecting rod journal substantially to one side of the center of rotation of the first and second rotor plates, and in so doing imparting a substantial increase in torque to the drive shaft as the piston moves through the power stroke.
Figure 4:
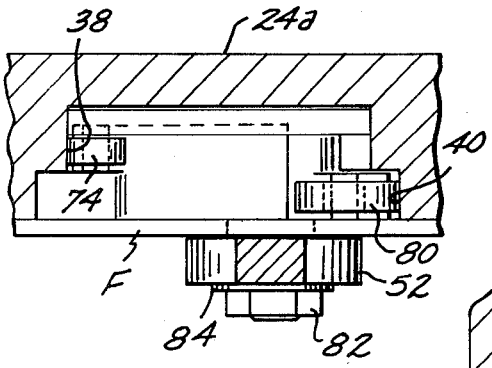
FIG. 4 is a transverse cross sectional view of the engine taken on the line 4—4 of FIG. 2.
Figure 5:
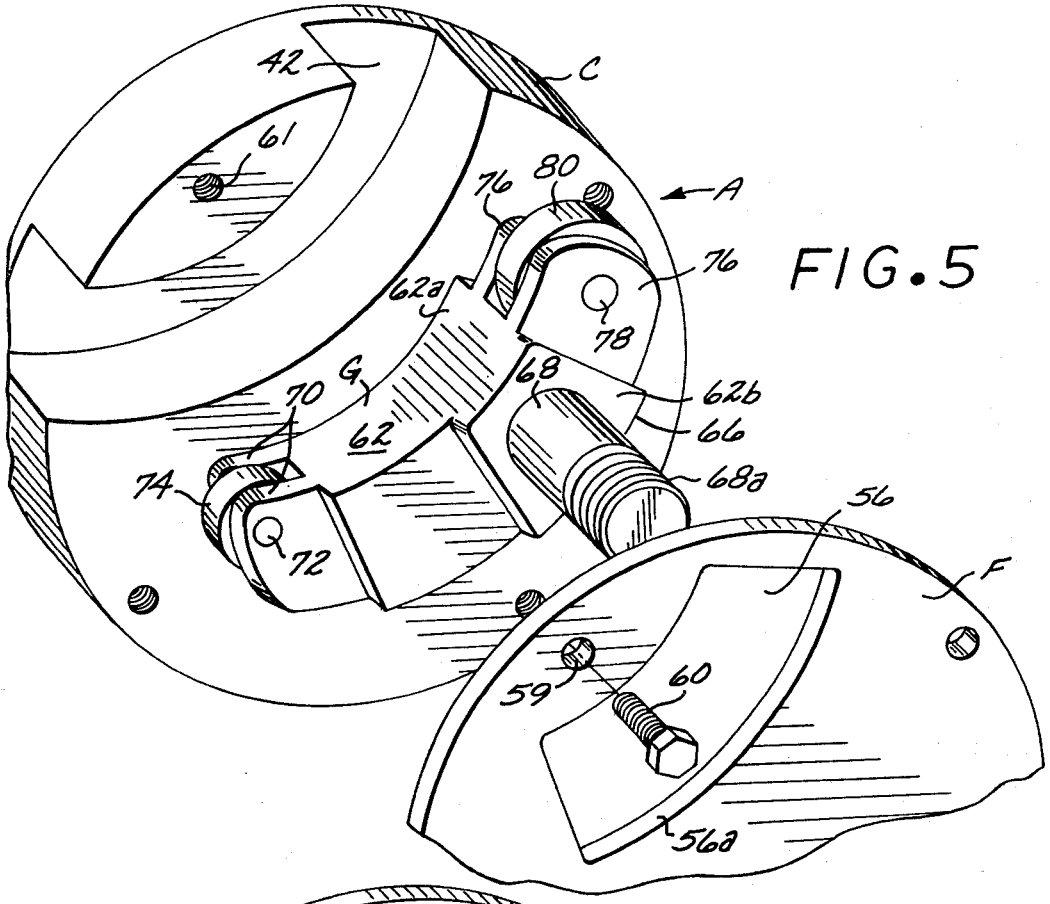
FIG. 5 is an exploded perspective view of the first and second rotor plates and swing throw crank structure operatively associated therewith.
Figure 6:
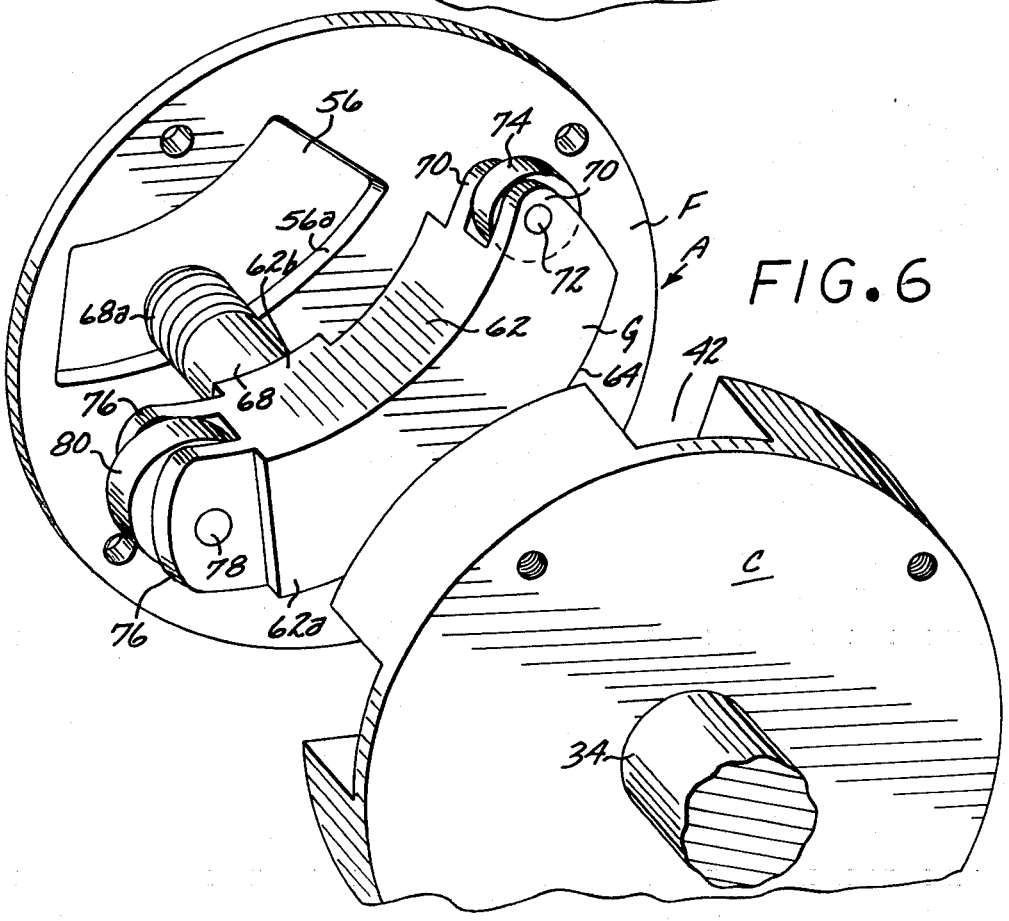
FIG. 6 is an exploded perspective view of the components shown in FIG. 5 but taken in an opposite direction relative thereto.

The swing throw crank structure A of the present invention is best seen in FIGS. 5 and 6, and is used in conjunction with an internal combustion engine B that is illustrated in FIGS. 1 and 2. The internal combustion engine B is best seen in FIG. 1 includes a cylinder 10 having an upper end 10*a* and a lower end 10*b*. The cylinder has a longitudinal center line 12 therein. A head 14 is secured to the upper end of the cylinder by bolts 16, with the heads supporting a spark plug 18 and valves 20 and 22 that are operated by a mechanism not shown that is conventional in internal combustion engines. The valves 20 and 22 permit the discharge of fuel charges into the cylinder 10 and the removal of products of combustion from the cylinder as reciprocating movement of a piston D takes place.

The cylinder 10 is illustrated as being situated above a hollow engine block 24 that is defined by a rear wall 24*a*, top wall 24*b*, bottom 24*c*, and a pair of side walls 24*d*. The top wall 24*b* has an opening 26 therein from which the cylinder 10 extends upwardly. The forward portion of the block 24 has a cover plate removably mounted thereon and secured thereto by bolts or other conventional fastening means.

Figure 3:
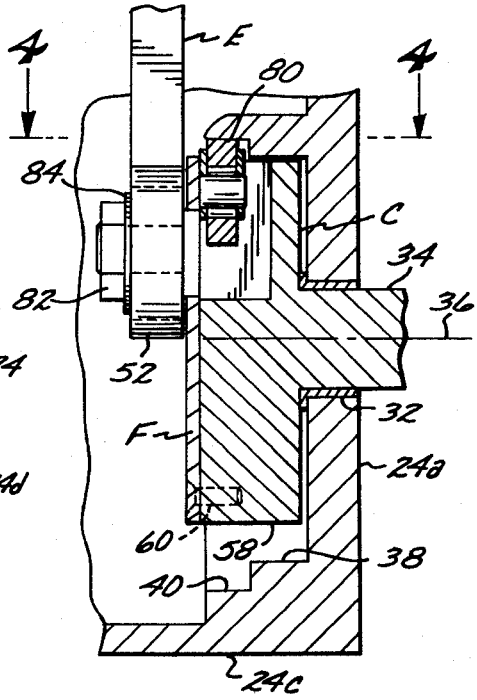
FIG. 3 is a vertical cross sectional view of the engine taken on the line 3—3 of FIG. 1.

In FIG. 3 it will be seen that the rear wall 24*a* supports a bearing 32 in which a fly wheel supporting drive shaft 34 is rotatably supported, with the drive shaft having a longitudinal axis of rotation 36 that lies in the same vertical plane as center line 12 of the cylinder 10. The block 24 within the interior thereof defined a rearwardly disposed non-circular first cam surface 38 and a generally elliptical second cam surface 40 being situated forwardly therefrom.

A first rotor plate C is secured to a forward end of the drive shaft 34 and is situated within the interior of the block 24, with the first rotor plate C having an off centered, arcuate, transverse slot 42 formed in the forward face thereof.

The piston D includes a wrist pin 50 as is conventional with such devices. The wrist pin 50 is pivotally engaged by the upper end of a connecting rod E, which connecting rod on the lower end thereof has a journal 52. The connecting rod E has a longitudinal center line 54. A second rotor plate F as may best be seen in FIG. 3 and 5 is positioned forwardly of the first rotor plate C. The second rotor plate F has an arcuate opening 56 therein that has a force receiving edge 56*a* and is aligned with the slot 42. The first and second rotor plates C and F as may best be seen in FIG. 3 are held in fixed transverse relationship by screws or bolts 60 that extend through openings 59 to engage tapped recesses 61 as shown in FIG. 5.

A force transmitting assembly G is provided as shown in FIGS. 5 and 6, that includes an elongate arcuate body 62 slidably disposed between rotor plates C and F, the body 62 has a first arcuate force transmitting member 62*a* projecting rearwardly therefrom as illustrated in FIG. 5 and a second arcuate force transmitting member 62*b* that projects forwardly therefrom. The first force transmitting member 62*a* has a force transmitting edge 64 as shown in FIG. 6.

The second force transmitting member 62*b* has a forced transmitting edge 66 illustrated in FIG. 5. A stub shaft 68 projects forwardly from the second force transmitting member 62*b* as shown in FIG. 5, with the stub shaft having threads 68*a* formed on the forward end portion thereof. A pair of laterally spaced first lugs 70 project from a first end portion of the elongate body 62 as shown in FIGS. 5 and 6, with the pair of lugs supporting a shaft 72 therebetween, on which a first cam roller 74 is rotatably supported. A pair of second lugs 76 project outwardly from the body from a second end portion of the body 62 and likewise support a shaft 78 therebetween on which a second cam roller 80 is mounted.

When the force transmitting assembly G is positioned between the first and second rotor plates C and F, the first force transmitting member 62*a* is slidably positioned within the slot 42, and the second force transmitting member 62*b* situated within the opening 56. The stub shaft 68 projects forwardly through the opening 56 and is rotatably engaged by the lower journal 52 of the connecting rod E. The lower journal 52 is removably supported on the stub shaft 68 by a nut 82 that engages the threads 68*a*. A washer 84 is supported on the shaft 68 and is interposed between the throw 52 and nut 82 as shown in FIG. 3.

As the piston D reciprocates upwardly and downwardly in the cylinder 10 of the engine B, the first and second force transmitting members 62*a* and 62*b* reciprocate in unison within the slot 42 and opening 56. In FIG. 1 the piston D is illustrated as approaching dead center, with the center line 54 of the connecting rod disposed to the left of the center line of the cylinder 10, assuming clockwise rotation of the first and second rotor plates C and F that is indicated by the arrow 86.

In FIG. 2 the piston D has moved upwardly in cylinder 10 to top dead center, and the force transmitting assembly G has been moved by cam 38 and cam roller 74 to a position well forward of center line 12. At top dead center, the center line 54 of the connecting rod E is situated to the right of center line 12 and is at a substantial vertical angle relative thereto. The major portion of the force receiving edge 56*a* of opening 56 and the force transmitting edge 66 of second force transmitting member 62*b* are on the right hand side of the cylinder center line 12. The lowermost portion of the force receiving edge 56*a* when the force transmitting assembly G is so disposed is at an angle N with the center line 12, which angle N is preferably sixty-five degrees although it may vary on each side of the figure.

When the power stroke reaches bottom of travel, the force transmitting assembly will move from the upwardly inclined position illustrated in FIG. 2 to one where it is substantially vertically disposed with the force transmitting edge 56*a* now being positioned to the left of the center line 12.

From the above description it will be seen that when the piston D is at top dead center, and the air fuel mixture exploded when at maximum compression, the force generated by the exploding charge of fuel is transmitted to the first and second rotor plates C and F at a substantial distance forward from the center of rotation thereof to obtain maximum rotational torque on the drive shaft 34. The radii of curvature of the slot 42 and opening 56 must be so selected that the first and second force transmitting members 62*a* and 62*b* slide smoothly therein as the first and second rollers 74 and 80 roll on the first and second cam surfaces 38 and 40.

A cover plate (not shown) maybe removably secured to the forward surface of housing 24 by conventional means to cooperate with the housing to define a confined space in which the rotating components of the invention are situated.

What is claimed is:

1. An improved swing throw crank structure in combination with an internal combustion engine that includes a piston, a cylinder in which said piston reciprocates, a piston rod pivotally connected to said piston, said piston rod including a journal, and a drive shaft rotatably supported in a fixed position relative to said cylinder for transforming reciprocating movement of said piston to rotary motion of said drive shaft, said swing throw crank structure including:

a. first and second parallel, laterally spaced rotor plates that are co-axially aligned, said first rotor plate having an arcuate slot extending within a side surface thereof most adjacent said second rotor plate, said second rotor plate having an arcuate opening therein transversely aligned with said slot, said first rotor plate secured to said drive shaft, said slot and opening each partially defined by a force receiving edge of said first and second rotor plates;

b. first means for maintaining said first and second rotor plates in fixed laterally spaced relationship;

c. a force transmitting assembly at least partially disposed between said first and second rotor plates that include an elongate rigid body that has first and second end portions, a first arcuate force transmitting member projecting rearwardly from said body that slidably engages said slot, a second arcuate force transmitting member that projects forwardly from said body and slidably engages said opening, and first and second transversely spaced cam rollers rotatably supported from said first and second end portions of said body;

d. a stub shaft that extends outwardly from said second force transmitting member and is rotatably engaged by said journal of said connecting rod; and e. first and second generally elliptical, transversely spaced, cam surface defining means that are at all times engaged by said first and second cam rollers and are so related to said force transmitting assembly that a power stroke only starts as said piston moves through top dead center and said second force transmitting member and the portion of said force receiving edge of said opening in contact therewith have moved to a position substantially to one side of the axis of rotation of said first and second rotor plates and continues to be so disposed until substantially bottom dead center on the power stroke is reached to substantially increase the torque delivered to said drive shaft in the rotation thereof over that attained when a conventional crank is employed to rotate a drive shaft.

2. A swing throw crank structure as defined in claim 1 in which said internal combustion engine includes an engine block defined by a rear wall, top wall, bottom wall and a pair of side walls that extend forwardly from said rear wall to terminate in forwardly disposed flat surfaces, said top wall supporting said cylinder, and a cover plate removably secured to said forwardly disposed flat surfaces to cooperate with said engine block to define a confined space in which said first and second rotor plates are disposed, with said connecting rod extending into said confined space through an opening in said top wall, and said top wall, bottom wall and pair of side walls having said cam surfaces defined on an interior thereof.

3. A swing throw crank structure as defined in claim 2 in which said first cam surface is situated rearwardly of said second cam surface as is said first cam roller relative to said second cam roller, with said first and second cam rollers at all times in rolling contact with said first and second cam surfaces.

4. A swing throw crank structure as defined in claim 3 which in addition includes a bearing supported in said rear wall, said bearing rotatably supporting said drive shaft.

* * * * *